United States Patent [19]

Crabb, Jr.

[11] Patent Number: 4,738,121

[45] Date of Patent: Apr. 19, 1988

[54] ICE GENERATING MACHINE

[75] Inventor: Richard V. Crabb, Jr., Aromas, Calif.

[73] Assignee: Growers Ice Company, Salinas, Calif.

[21] Appl. No.: 1,785

[22] Filed: Jan. 8, 1987

[51] Int. Cl.[4] ..... F25C 1/12

[52] U.S. Cl. ..... 62/347; 165/76; 165/166; 403/408.1

[58] Field of Search ..... 62/347, 348, 352; 403/408.1; 165/76, 166

[56] References Cited

U.S. PATENT DOCUMENTS

| | | | |
|---|---|---|---|
| 164,156 | 6/1875 | Ellis | 165/166 |
| 2,064,931 | 12/1936 | Lysholm | 165/166 X |
| 3,334,399 | 8/1967 | Teeguarden | 165/166 X |
| 3,444,926 | 5/1969 | Stalberg | 165/166 |
| 4,058,980 | 11/1977 | Ahlen | 165/166 X |
| 4,107,943 | 8/1978 | Ohling | 62/347 X |
| 4,192,151 | 3/1980 | Carpenter | 62/347 X |
| 4,279,297 | 7/1981 | Dziedzic et al. | 165/166 X |
| 4,593,537 | 6/1986 | Visser | 62/345 |

*Primary Examiner*—William E. Tapolcai
*Attorney, Agent, or Firm*—Gerald L. Moore

[57] ABSTRACT

An ice generating system including an ice generating assembly (160) including a plurality of plates (28) having internal coolant passages (28A) with the plates clamped together by tension bolts (51) with spacers (54) between adjacent plates to space the plates and allow the formation of ice therebetween. Water is pumped into weirs (37) positioned above each plate and permitted to flow over both plate surfaces for forming ice. The spacers serve to prevent the flow of water over the plate edges so the ice will not mechanically lock on the plates. The ice is released from the plates by pumping warm gases through the coolant passages and transporting the released ice by screw conveyors (55) positioned beneath each plate bay.

3 Claims, 3 Drawing Sheets

ICE GENERATING MACHINE

FIELD OF THE INVENTION

An improved plate-type ice maker configured primarily to be transported on a vehicle.

BACKGROUND OF THE INVENTION

Recent advances in agricultural technology have allowed the harvesting and packing of produce directly in the field. After injecting a water and ice solution, commonly referred to as liquid ice, into the cartons the produce is ready for shipment to the market. By use of a portable icing station close to the harvest field, two main benefits are derived. Firstly, the icing equipment can be amortized over a longer period throughout the year because the equipment can be used with more types of produce at different locations, and secondly, travel time and costs of transportation for the produce are reduced significantly by doing away with the time previously necessary to transport the produce to a fixed location ice plant.

In the past, portable ice generating equipment has been limited in generating capacity. Usually, such ice generating equipment utilizes a plate ice generator in which a liquid coolant is circulated through the center of a plurality of plate assemblies and water is passed over the exterior and allowed to freeze into ice sheets. Thereafter, by purging the plates of coolant and passing hot gas therethrough, the ice sheets are caused to disengage and drop downward for transport to a storage bin. Such generators have been limited in overall capacity due to the limited number of plates that have been mounted in the freezing section of a portable generator. Additionally, it has been usual to freeze on only one side of the plates. Further problems have existed with the ice encircling the plate ends and locking the ice sheet to the plates or, due to surface design, ice latching to the plate surface thereby making it difficult to disengage.

Attempts to solve the locking problem have involved either the limiting of the water flow to the center section of the plates to prevent the flow of water adjacent the edges of the plates, or the circulation of a hot fluid through passages in the edges of the plates to prevent the formation of ice in that area. Naturally, both of these designs have limited the overall capacity of the freezing unit. Additionally, if the ice is formed, separated from the plates, and then exposed to water, it can refreeze into a solid mass if the temperature of the ice is low enough. To prevent this occurrence, it has been common to limit the overall quantity of water passed over each plate in an effort to limit the amount of water dropping from the plates onto the separated ice.

It is the purpose of the present invention to provide a portable ice generator having a significantly greater ice making capacity than previous portable machines. Further, the invention allows for positive disengagement of the ice sheets from the plates and limits refreezing of the ice for easier handling once it is separated from the plates.

SUMMARY OF THE INVENTION

An ice generating assembly comprising a plurality of internally cooled plates positioned in parallel side-by-side relationship in an ice generating assembly. Insulating spacers are positioned between the outer edges of the plates and tension rods passing through platens fixed to the end of each plate are tightened to squeeze the plates and spacers together into one integral assembly. Thereafter, coolant is passed through passages in the plates and water is evenly distributed over the plate outside surfaces while being excluded from the end regions by the spacers. After ice is formed, the coolant is purged from the plate passages and hot gas is passed therethrough to separate the ice from the plates. The separated ice drops downward to a screw conveyor and is broken into pieces which are transmitted by the conveyor to a storage area. The conveyor housing includes openings to allow the escape of liquid and limit the refreezing of the ice into a solid bulk.

DESCRIPTION OF A PREFERRED EMBODIMENT

Figure 3:
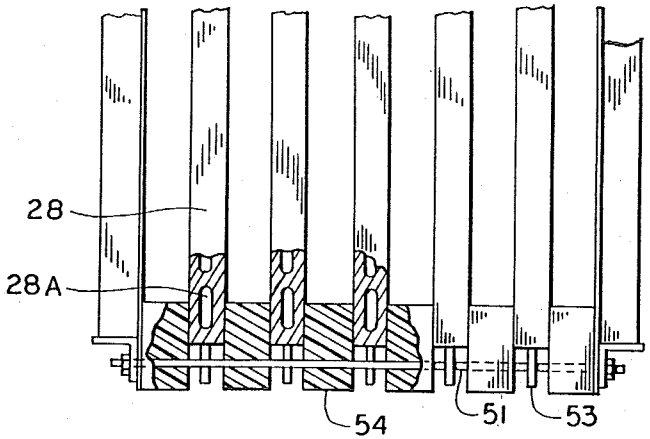
FIG. 3 is a top view of the ice generator of FIG. 2.
Figure 4:
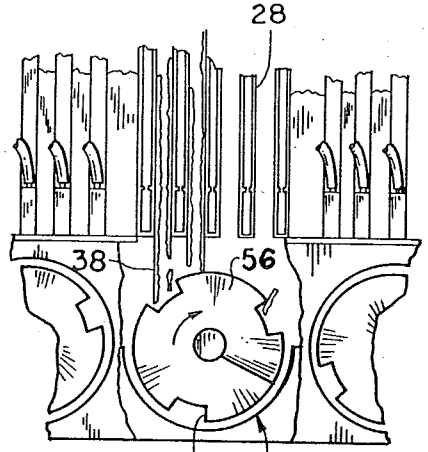
FIG. 4 is a partial view of the end of an ice generating assembly.
Figure 1:
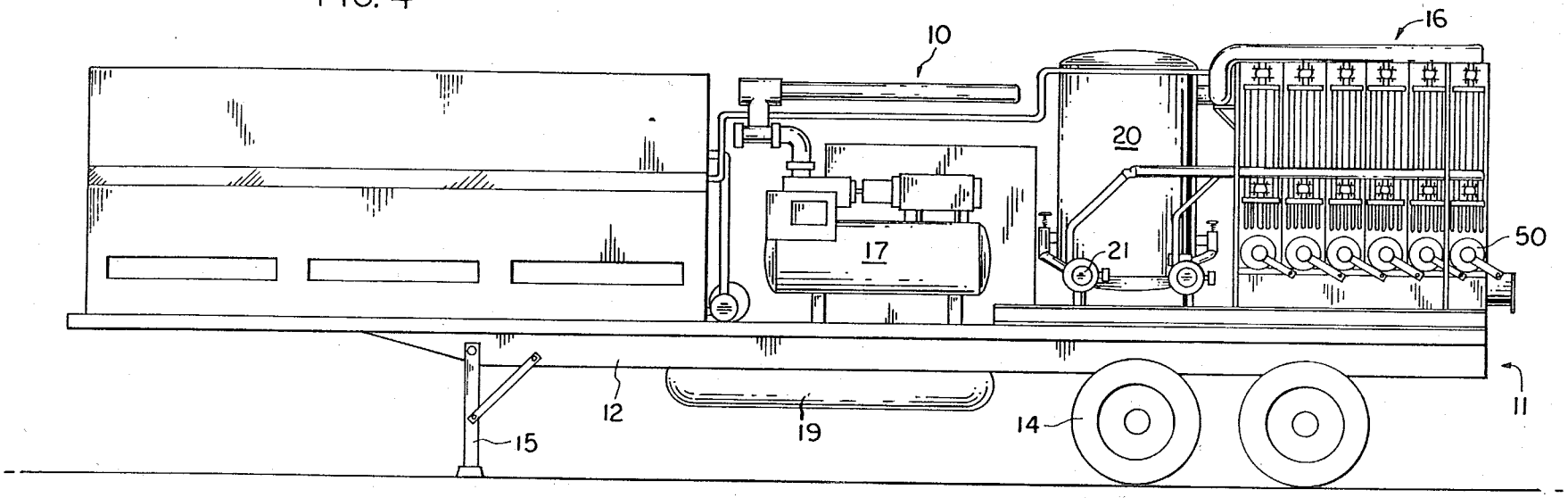
FIG. 1 is a side elevation view of the ice generator mounted on a trailer.
Figure 5:
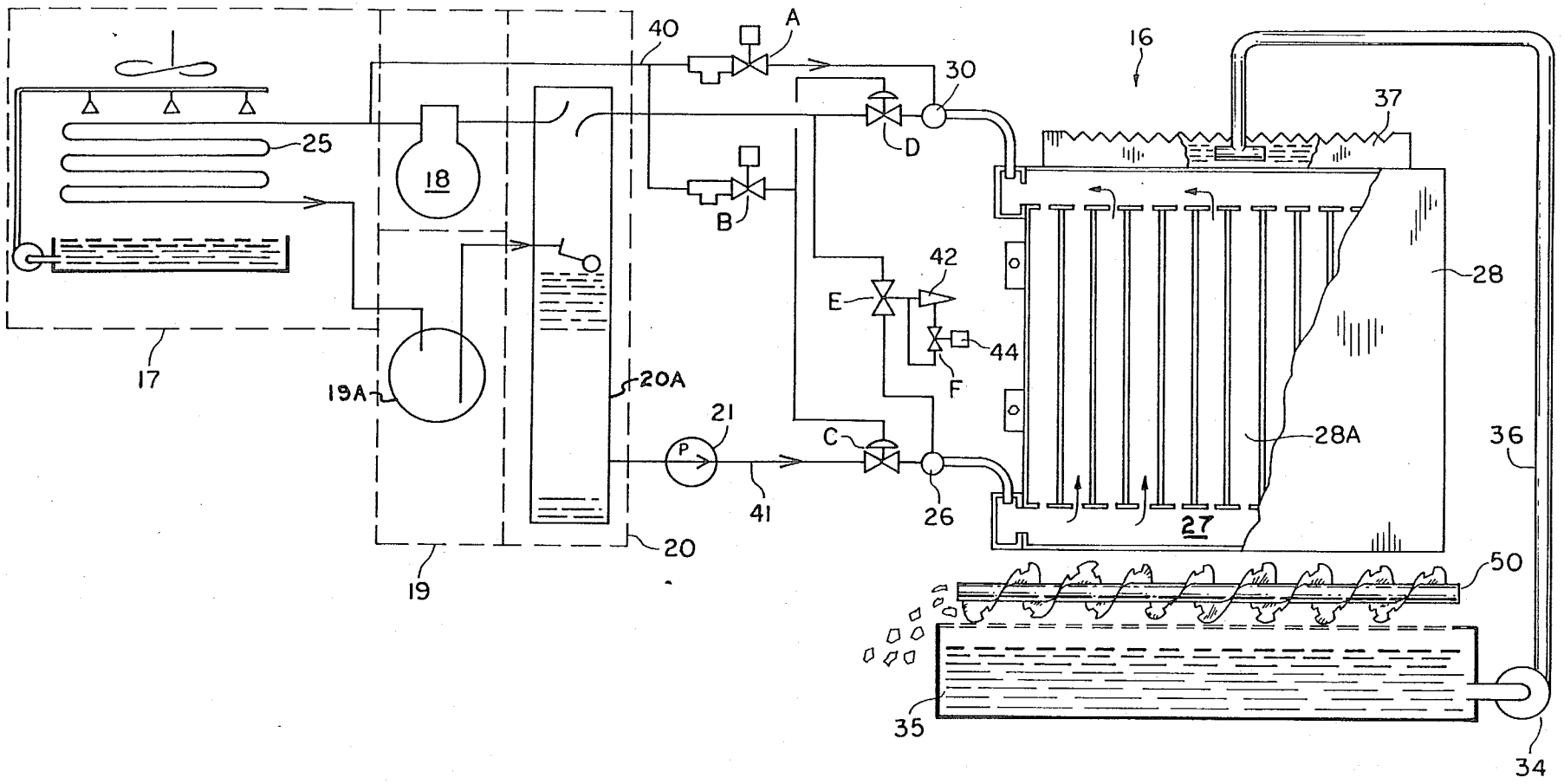
FIG. 5 is a schematic of the ice generating system.

In FIG. 1 is shown an ice generating system 10 mounted on a trailer 11 comprised of a flatbed 12, wheels 14, and a stanchion 15. The ice generating system is shown in FIG. 5 and comprises an ice generating assembly 16, a condenser 17, a compressor 18, a high-pressure receiver 19, a low-pressure receiver 20, and a coolant pump 21. The compressor 18 receives the refrigerant which it compresses and circulates as a gas through the coils 25 where it is condensed to a liquid, and circulated to the container 19A of the high pressure receiver 19 and the container 20A of the low-pressure receiver 20. The pump 21 receives coolant from the low pressure receiver and passes it through a valve C to a liquid manifold 26 from which it passes through the ice generating assembly. The liquid circulates from the lower header 27 up through the coolant passages 28A of the plates 28 to expand and absorb heat before collecting in a top header 29, and then flows through the gas manifold 30 and the valve D back to the low pressure receiver 20. This cooling cycle occurs while a water pump 34 is functioning to pump water from a sump 35 up through a vertical pipe 36 to weirs 37. This water then trickles down the plate sides for the formation of sheets of ice 38 (FIG. 4) on the outer surfaces of the plates.

For separating the ice from the plates, a defrost cycle is initiated wherein the coolant pump 21 is shut down and valve A opens to allow hot gas from the compressor to pass through the conduit 40 and the gas manifold 30 into the top header 29 for purging the plate passages 28A of coolant. Thereafter the gas circulates out through the lower header, the manifold 26 and through a back-pressure regulator valve E. The valve C, being closed, prevents passage of the gas to the low pressure receiver through the pipe 41. The back-pressure regulator at first is locked open by a regulator proper 42 which acts to open the valve through the action of energization of the solenoid 44. The opening of the valve F causes the regulator proper to go full open for a specified period of time. Thereafter, the solenoid is de-energized allowing the back-pressure regulator valve E to function normally to regulate the back-pressure of the gas passing through the line 46 back to the low-pressure receiver. By regulation of the pressure, optimum heating of the freezing plates is effected. During this time, a conveyor 50 is energized to rotate and transport to storage (not shown) the ice falling from the freeze plates.

Figure 2:
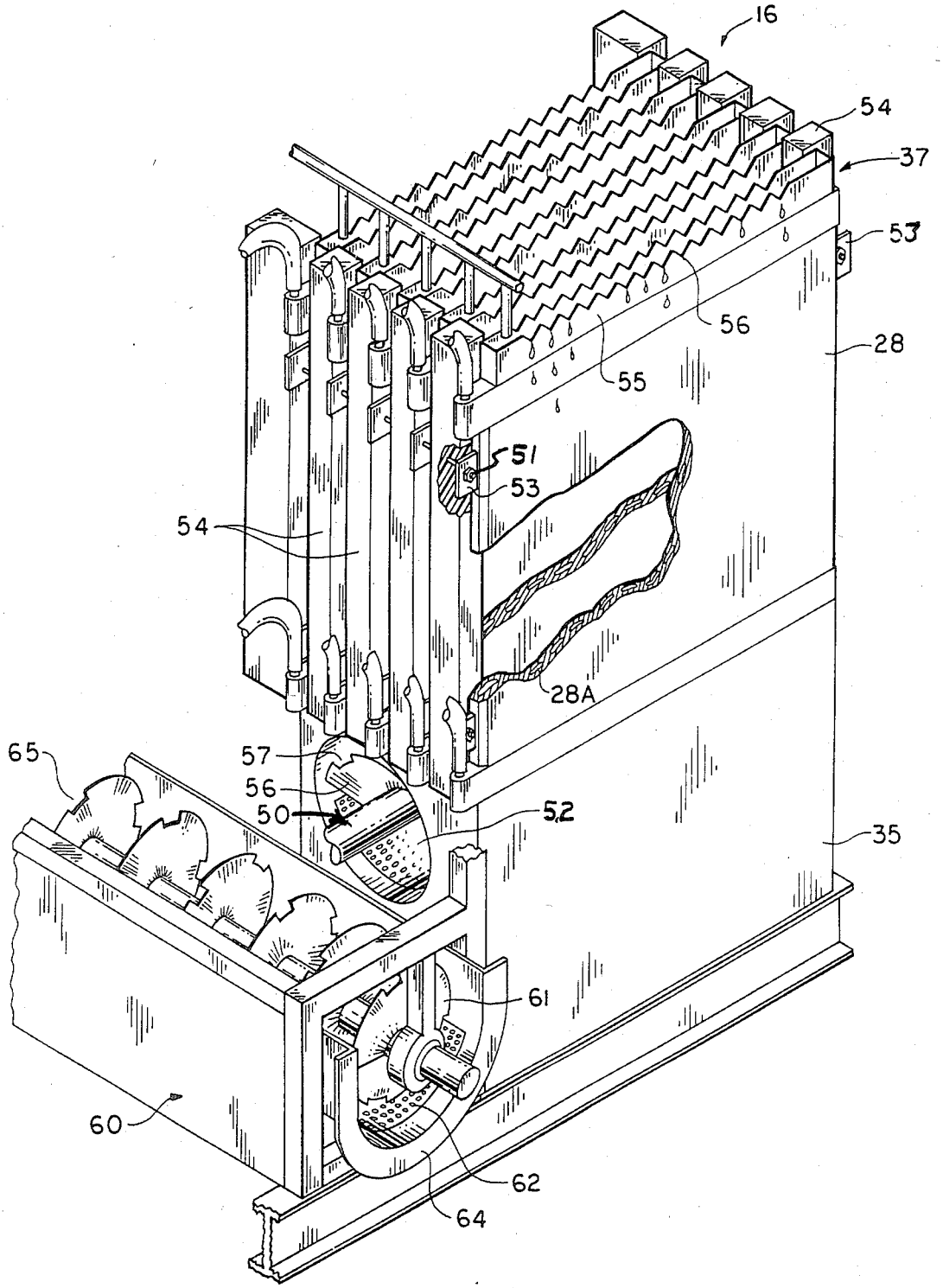
FIG. 2 is a partial perspective view of an ice generating assembly.

In accordance with the invention, each bank of the ice generating assembly is comprised of a sandwich construction to permit high density positioning of the freezing units and allow for a quick release of the formed ice from the plates. Accordingly, the ice generator is comprised of a plurality of banks of plates 28 each having internal passages 28A as shown in FIG. 2. Attached to these plates are brackets 53 extending from the ends and through which tension bolts 51 are passed for holding the plates together in side-by-side spaced relationship. Positioned between the plate ends are the spacers 54 made of an insulating material of sufficient rigidity to permit some compression while maintaining the plates in spaced relationship. These spacers are compressed against the outer edges of the plates so as to prevent the circulation of water along the plate ends. In this manner, ice is prevented from freezing at the plate edges which alleviates the problem of the ice mechanically locking to the plates and not releasing during the defrost cycle.

Positioned at the top of each plate is a weir 37 comprising an open-topped box structure having side walls 55 with a series of notches 56 in the top edge. Thus, water is pumped into each of these box structures by the pump 34 forcing the water through the distribution pipe 36 to fill the weir until it begins flow out the bottom of each of the "V" cuts. In this manner, the water is evenly distributed along the sides of the plates for an even buildup of ice on the plate vertical surfaces.

During the defrost cycle, hot gases are forced through the plates of each bank resulting in the plate surfaces warming and causing the ice to release therefrom. The ice drops down into contact with the conveyor 50 positioned beneath the plate bank and comprising a screw 56 having notches 57 in the edges to break up the ice sheets. Thus, the ice is moved to one end of the bank where it drops into a second conveyor 60. Excess water falling from the plates during the freeze cycle flows through the holes in the screen trough 52 and into the tank 35. The ice is carried away by a conveyor under each bank in a manner so as not to be exposed to water dropping from the plates of another bank thereby to maintain the ice relatively dry.

Thus, it can be seen that there is provided a compact structure of parallel-positioned plates spaced apart just enough to allow the formation of ice on both surfaces as the water is caused to trickle evenly down the plate outer surfaces while coolant is passed through the internal passages 28A. In this manner, a compact and efficient ice generating assembly is provided, enabling the generation of a much greater capacity of ice since the plates are positioned closer together and both surfaces are utilized for freezing. With the sandwich structure, the insulating spacers 54 prevent the formation of ice at the plate edges thereby allowing for a shortening of the defrost stage because the ice releases efficiently from the plate surfaces.

In the usual portable structure, there is provided the first trailer 11 as described carrying the complete ice generating assembly. Usually accompanying this trailer is a second trailer (not shown) for carrying ice storage containers into which the screw conveyor 60 comprising a power driven screw 61 in a screen trough 62 and a solid trough 64 transports the ice as it is formed. Notches 65 in the screw assist in breaking up the ice for easy transport. Naturally, the banks are defrosted one at a time in consecutive order so as not to overload the screw conveyor and to make efficient use of the warm compressor gases as they are cycled from bank to bank. In this manner, a very high capacity ice generator is provided which has proven to generate as much as 250 tons of ice in a 24 hour period. The ice has been used effectively in forming liquid ice for the cooling of produce, but naturally can be used for many other purposes.

I claim:

1. An ice generating system comprising:

a plurality of vertically positioned plates each having internal passages through which coolant can flow to cool the plate exterior surfaces and each having opposite vertically extending edges;

means circulating coolant through said plates to form ice on the exterior surfaces thereof;

means to heat said plates sufficiently to cause said ice to release from said plates and drop down beneath said plates; and means to support said plates comprising:

a plurality of spacers made of insulating material each formed to fit between the vertical edges of adjacent plates and seal against water flow between the plates and spacers while spacing the adjacent plates apart sufficiently to allow for the unobstructed formation of ice on the adjacent plate surfaces;

means to squeeze a plurality of said plates and spacers together in a sandwich assembly to form a single rigid structure comprising a bank of plates; and means to direct a flow of water over said plate surfaces between said spacers to form sheets of ice on said plate flat surfaces only while preventing the formation of ice on said plate edges.

2. An ice generating system as defined in claim 1 including a screw conveyor positioned beneath each bank of plates to receive and carry away the ice released from the plates.

3. An ice generating system as defined in claim 1 wherein said screw conveyor includes a power driven screw having notches in the outer edge to break up the ice dropping from said plates.

* * * * *